US008474545B2

(12) United States Patent
Takeuchi

(10) Patent No.: US 8,474,545 B2
(45) Date of Patent: Jul. 2, 2013

(54) SPRINKLER HEAD

(75) Inventor: Takashi Takeuchi, Ichinoseki (JP)

(73) Assignee: Senju Sprinkler Co., Ltd., Tokyo (JP)

( * ) Notice: Subject to any disclaimer, the term of this patent is extended or adjusted under 35 U.S.C. 154(b) by 250 days.

(21) Appl. No.: 13/119,481

(22) PCT Filed: Sep. 30, 2008

(86) PCT No.: PCT/JP2008/002722

§ 371 (c)(1),
(2), (4) Date: Jun. 2, 2011

(87) PCT Pub. No.: WO2010/038253

PCT Pub. Date: Apr. 8, 2010

(65) Prior Publication Data

US 2011/0247836 A1 Oct. 13, 2011

(51) Int. Cl.
*A62C 37/08* (2006.01)

(52) U.S. Cl.
USPC ..... 169/37; 169/39; 239/507

(58) Field of Classification Search
USPC ..... 169/37, 38, 39, 41, 16, 17; 239/507, 239/509, 514
See application file for complete search history.

(56) References Cited

U.S. PATENT DOCUMENTS 4,014,388 A 3/1977 Anderson
4,066,129 A * 1/1978 Anderson ..... 169/37
5,072,792 A * 12/1991 Simons et al. ..... 169/37
5,372,203 A * 12/1994 Galaszewski ..... 169/37
6,805,203 B2 * 10/2004 Retzloff et al. ..... 169/37
7,055,614 B1 6/2006 Ide
7,185,567 B2 3/2007 Ide
7,314,094 B2 * 1/2008 Gow et al. ..... 169/38

FOREIGN PATENT DOCUMENTS

JP 4-44957 U 4/1992
JP 2001-157722 A 6/2001
JP 2001-161852 A 6/2001
JP 2008-086394 A 4/2008

OTHER PUBLICATIONS

International Search Report for PCT Patent App. No. PCT/JP2008/002722 (Dec. 22, 2008).

* cited by examiner

*Primary Examiner* — Davis Hwu
(74) *Attorney, Agent, or Firm* — Cermak Nakajima LLP; Tomoko Nakajima

(57) ABSTRACT

To provide a sprinkler head including: a sprinkler head main body having a nozzle therein, connected to water supply piping, and installed in a ceiling; a cover plate concealing the sprinkler head main body; a retainer disposed so that the cover plate is located below the ceiling surface and capable of releasing the cover plate in the event of fire; and a cylindrical member that is attached to the sprinkler head main body and to which the retainer is detachably connected, and having a structure that can save the trouble of removing and reattaching a protective cap at the time of installation of the sprinkler head. The sprinkler head has such a structure that a protective cap attached to the sprinkler head is fitted to the outer periphery of the sprinkler head main body.

6 Claims, 5 Drawing Sheets

SPRINKLER HEAD

This application is a national phase entry under 35 U.S.C. §371 of PCT Patent Application No. PCT/JP2008/002722, filed on Sep. 30, 2008, which is incorporated by reference.

TECHNICAL FIELD

The present invention relates to sprinkler heads for fire extinguishing.

BACKGROUND ART

Sprinkler heads are installed in the ceiling surface or wall surface in a building and have at one end thereof a nozzle that can be connected to piping leading to a water supply source, and a heat sensitive operating portion is provided at the other end. At normal times, the heat sensitive operating portion supports a valve that closes the nozzle.

Examples of the above-described sprinkler heads include concealed type sprinkler heads that are flush-mounted in the ceiling surface or wall surface and covered with a cover plate.

Concealed-type sprinkler heads are used as aesthetically excellent sprinkler heads and include that described in Patent Literature 1. In the concealed type sprinkler head of Patent Literature 1, a cylindrical member is provided outside a so-called frame-yoke-type sprinkler head in which a horseshoe-shaped frame extends from the end of a nozzle and a deflector is installed on the extension of the nozzle, and an engaging portion to be engaged with a cover plate is provided in the lower part of the cylindrical member.

The sprinkler head shown in FIG. 6 has the same structure as the concealed type sprinkler head of Patent Literature 1. A cylindrical member A is provided outside a frame-yoke-type sprinkler head SH (hereinafter referred to as "sprinkler head SH"). A cylindrical retainer B to which a cover plate P is bonded with a low melting alloy is connected to the lower part of the cylindrical member A.

As the structure of the connection between the cylindrical member A and the retainer B, a spiral groove A1 formed in the lower part of the cylindrical member A and a protrusion B1 formed on the outer peripheral surface of the retainer B are configured to be engaged with each other.

As shown in FIG. 6, the sprinkler head SH, the cylindrical member A, and the retainer B are disposed in the ceiling. Only the cover plate P is disposed close to the ceiling surface. The cover plate P is connected to the retainer B with a low melting alloy and therefore drops due to the heat at the time of a fire. By the drop of the cover plate P, the sprinkler head SH is exposed.

Following the exposure of the sprinkler head SH, a heat sensitive portion G of the sprinkler head SH operates and breaks, and opens the valve inside the sprinkler head SH, and thereby water is sprinkled from the sprinkler head SH and extinguishes the fire.

Patent Literature 1: U.S. Pat. No. 4,014,388 specification

DISCLOSURE OF INVENTION

Problems to be Solved by the Invention

In order to prevent the above-described concealed type sprinkler head from deformation or breakage due to external shock at the time of transportation or construction, a cylindrical protective cap C is fitted on the inner peripheral surface of the cylindrical member as shown in FIG. 5. Since the protective cap C is fitted on the inner peripheral surface of the cylindrical member, the retainer B cannot be attached to the cylindrical member A without removing the protective cap C.

The sprinkler head SH has an engaging portion K with which a tightening tool is engaged between a frame F and a piping connecting thread portion T. When attaching the sprinkler head SH to piping, the protective cap C is removed from the cylindrical member A, the engaging portion K of the sprinkler head SH in the cylindrical member A is grasped with the tightening tool, and the thread portion T of the sprinkler head SH is engaged with a thread portion of the piping.

After the connection to the piping is completed, the protective cap C is attached to the cylindrical member A again in order to protect the sprinkler head SH from external force at the time of installation of a ceiling board. After the installation of the ceiling board is completed, the protective cap C is removed, and the retainer B to which the cover plate P is installed is attached to the cylindrical member A. The sprinkler head SH in the cylindrical member A is concealed by the cover plate P.

The removal of the protective cap C from the above-described concealed head is performed twice. The attachment and removal of the protective cap C are troublesome for workers. In addition, it is highly likely that errors such as forgetting to remove the protective cap C are made.

In view of the above-described problem, an object of the present invention is to provide a sprinkler head having a structure that can save the trouble of removing and reattaching a protective cap at the time of installation of the sprinkler head.

Means for Solving the Problems

To attain the above-described object, the invention described in Claim 1 is a sprinkler head including: a sprinkler head main body having a nozzle therein, connected to water supply piping, and installed in a ceiling; a cover plate concealing the sprinkler head main body; a retainer disposed so that the cover plate is located below the ceiling surface and capable of releasing the cover plate in the event of fire; and a cylindrical member that is attached to the sprinkler head main body and to which the retainer is detachably connected, wherein a protective cap attached to the sprinkler head is fitted to the outer periphery of the sprinkler head main body.

The invention described in Claim 2 is the sprinkler head according to Claim 1, wherein an engaging portion to be engaged with a tightening tool for connecting the sprinkler head main body to the water supply piping is formed inside the cylindrical member.

The invention described in Claim 3 is the sprinkler head according to Claim 1 or 2, wherein an engaging portion to be engaged with the tightening tool is formed between the protective cap attached to the sprinkler head main body and a connecting portion of the sprinkler head main body connected to the water supply piping.

The invention described in Claim 4 is the sprinkler head according to Claim 1 or 2, wherein in the sprinkler head main body, the engaging portion to be engaged with the tightening tool has a diameter larger than the outside diameter of the protective cap and smaller than the inside diameter of the cylindrical member.

The invention described in Claim 5 is the sprinkler head according to Claim 1, wherein a deflector provided on the extension of the nozzle exit of the sprinkler head main body has such a structure that the deflector is normally housed in the sprinkler head main body and is protruded from the sprinkler head main body at the time of operation.

Advantages

According to the invention described in Claim 1, fitting a protective cap to the outer periphery of the sprinkler head main body makes it possible to provide an engaging portion to be engaged with a tightening tool inside the cylindrical member and to connect the sprinkler head to the water supply piping without removing the protective cap.

According to the invention described in Claim 2, since an engaging portion to be engaged with a tightening tool for connecting the sprinkler head main body to the water supply piping is formed inside the cylindrical member, the tightening tool can be engaged with the engaging portion, with the protective cap attached to the sprinkler head main body.

According to the invention described in Claim 3, since an engaging portion to be engaged with the tightening tool is provided between the protective cap attached to the sprinkler head main body and a connecting portion of the sprinkler head main body connected to the water supply piping, the engaging portion is provided on the sprinkler head main body.

According to the invention described in Claim 4, since the engaging portion to be engaged with the tightening tool is provided in a place having a diameter larger than the outside diameter of the protective cap and smaller than the inside diameter of the cylindrical member, the engaging portion to be engaged with the tightening tool can be provided, for example, even when the sprinkler head main body and the cylindrical member are integrated.

According to the invention described in Claim 5, since a deflector has such a structure that the deflector is housed in the sprinkler head main body and is protruded from the sprinkler head main body at the time of operation, the deflector does not interfere with the fitting of the protective cap onto the sprinkler head main body.

BEST MODE FOR CARRYING OUT THE INVENTION

In the sprinkler head of the present invention, a cylindrical member is attached to the outside of a sprinkler head main body, a retainer is detachably connected to the cylindrical member, and the retainer is provided with a cover plate that has a size sufficient to conceal the sprinkler head.

The cylindrical member is installed between a water supply piping connecting thread and a tightening tool engaging portion of the sprinkler head main body. The cylindrical member may be provided with holes so that the thermal air currents at the time of a fire can easily pass through the inside of the cylindrical member. Cutouts may be provided in the peripheral surface of the cylindrical member in accordance with the shape of protective cap or the shape of sprinkler head main body.

When the cylindrical member and the sprinkler head main body are integrated, the above-described engaging portion can also be provided by forming protrusions, grooves, cutouts, or holes on or in the inner surface of the cylindrical member.

The retainer and the cylindrical member may be connected by means of engagement by thread structure, engaging pawls provided in one member with the other member, or fitting. In any of these cases, the retainer is detachable from the cylindrical member.

The connection between the retainer and the cover plate needs to be released by heat from a fire. Bonding with a low melting alloy, or a shape-memory element that can deform when a predetermined temperature is reached can be used as a means for connecting the retainer and the cover plate.

The protective cap is fitted to the outer periphery of the sprinkler head main body. At that time, the protective cap is configured not to interfere with the engaging portion to be engaged with a tightening tool. It is preferable that the protective cap have such a structure that when the protective cap is attached to the sprinkler head main body, the retainer cannot be connected to the cylindrical member. Specifically, the protective cap has such a length that when the cap is attached, the retainer does not reach the cylindrical member.

EMBODIMENT

The embodiment of the present invention will be described with reference to FIGS. 1 to 4. FIG. 1 is a sectional view of a sprinkler head of the present invention. FIG. 2 is a sectional view of the sprinkler head attached to piping. FIG. 3 is a bottom view of FIG. 2. FIG. 4 shows the sprinkler head in operation.

The sprinkler head of the present invention shown in FIGS. 1 to 3 includes a sprinkler head main body 1, a cylindrical member 2, a retainer 3, and a cover plate 4.

The sprinkler head main body 1 has on its outside a male thread 6 to be connected to water supply piping 5. A nozzle (not shown) is provided inside the male thread 6. The exit end of the nozzle is closed by a valve, and the valve is supported by a heat sensitive operating portion. The internal mechanism of the sprinkler head main body 1 is known from Japanese Unexamined Patent Application Publication No. 7-284545 and does not have a direct relationship with the present invention, so the detailed description thereof will be omitted.

At the base of the male thread 6, a flange portion 7 is formed. In the side surface of the flange portion 7, a plurality of vertical grooves 7A are formed at regular intervals and used as an engaging portion to be engaged with a tightening tool.

Under the flange portion 7, a cylindrical frame 8 is provided that has a diameter smaller than the outside diameter of the flange portion 7. The frame 8 houses the above-described valve, a deflector with which water discharged from the nozzle collides, and a heat sensitive operating portion.

A cylinder 9 and a heat collector 10 are installed under the frame 8. The cylinder 9 is incorporated in the heat sensitive operating portion. When the low melting alloy filling the cylinder 9 melts, the heat sensitive operating portion breaks up. The heat collector 10 has a function to absorb heat from a fire and transfer heat to the low melting alloy in the cylinder 9. It is preferable that the heat collector be made of copper or copper alloy having high thermal conductivity.

The cylindrical member 2 has a cylindrical shape, and the upper part thereof is fixed between the flange portion 7 and the male thread 6 of the sprinkler head main body 1. The cylindrical member 2 has an opening in the lower part thereof. The cylinder 9 and the heat collector 10 of the sprinkler head main body 1 are protruding from the lower end of the cylindrical member 2.

In the peripheral surface of the cylindrical member 2, a spiral groove 11 is formed as a means for connecting with the retainer 3. The spiral groove 11 is engaged with the protrusion 12 formed on the outer peripheral surface of the retainer 3. The height position of the retainer 3 can be regulated.

The retainer 3 is connected to the cylindrical member 2 as described above. The retainer 3 has a cylindrical shape. The retainer 3 has a flange portion 13 formed at the lower end thereof and a plurality of legs 14 extending downward from the flange portion 13.

The ends of the legs 14 are bent horizontally, and connecting surfaces 15 for connecting with the cover plate 4 are formed. A low melting alloy 16 is interposed between the connecting surfaces 15 and the cover plate 4. The cover plate 4 and the connecting surfaces 15 are bonded by the low melting alloy 16.

The low melting alloy 16 is melted by the heat at the time of a fire and releases the cover plate 4, and therefore the melting temperature of the low melting alloy 16 is lower than the melting temperature of the low melting alloy filling the cylinder 9.

The cover plate 4 is a disk-like thin plate, and the edge thereof is bending toward the ceiling. The surface of the cover plate 4 opposite to the surface connected to the retainer 3 is decorated in substantially the same color as the color of the ceiling. Copper or copper alloy having excellent bonding properties to the low melting alloy 16 is suitable as the material of the cover plate 4. If an elastic body such as a spring is installed between the cover plate 4 and the flange portion 13 of the retainer 3, the drop of the cover plate 4 due to the melting of the low melting alloy 16 at the time of a fire can be hastened.

FIG. 2 shows a sectional view in a state where a protective cap 20 is attached. In FIG. 2, the protective cap 20 has a bottomed cylindrical shape and is fitted on the outer peripheral surface of the frame 8. The opening end of the upper part thereof is in contact with the flange portion 7. The protective cap 20 protects the heat sensitive operating portion and the heat collector of the sprinkler head from external shock.

FIG. 3 shows the sprinkler head of FIG. 2 viewed from the bottom of the protective cap. In FIG. 3, vertical grooves 7A of the flange portion 7 are provided beyond the outside diameter of the protective cap 20, so that a tightening tool can engage with the vertical grooves 7A. Therefore, the sprinkler head can be attached to the piping with a tightening tool, with the protective cap 20 attached thereto.

The protective cap 20 has such a length that when the protective cap 20 is attached to the sprinkler head, the protrusion 12 of the retainer 3 cannot engage with the spiral groove 11 of the cylindrical member 2. Therefore, when installing the retainer 3 in the cylindrical member 2, the retainer 3 cannot be installed in the cylindrical member 2 without removing the protective cap 20. Therefore, forgetting to remove the protective cap 20 can be prevented.

Next, the procedures for installing the above-described sprinkler head will be described.

Before the above-described sprinkler head is connected to the water supply piping, it is in a state where the cylindrical member 2 is installed outside the sprinkler head main body 1, and the protective cap 20 is fitted on the sprinkler head main body 1 inside the cylindrical member 2.

A tightening tool (not shown) is inserted into the cylindrical member 2 from the bottom of the protective cap. The tightening tool is engaged with the vertical grooves 7A of the sprinkler head main body 1. The male thread 6 of the sprinkler head main body 1 is engaged with the female thread formed at the end of the water supply piping 5 and thereby connected to the water supply piping.

In the next step, a ceiling board 21 is installed. In the place in the ceiling board 21 where the sprinkler head is installed, a hole is made. After the installation of the ceiling board 21, the tip of the protective cap 20 attached to the sprinkler head main body 1 is protruding from the ceiling surface.

Next, the protective cap is removed from the sprinkler head main body 1, and the retainer 3 is installed to the cylindrical member 2. At that time, if one tries to attach the retainer 3 with the protective cap 20 remaining on the sprinkler head main body 1, the bottom surface of the protective cap 20 comes into contact with the back surface of the cover plate 4, and the retainer 3 and the cylindrical member 2 cannot be connected. Therefore, forgetting to remove the protective cap 20 can be prevented.

The protrusion 12 formed on the side surface of the retainer 3 is engaged with the spiral groove 11 of the cylindrical member 2, and regulation is performed so that the flange portion 13 connected to the lower part of the retainer 3 is in contact with the ceiling board. Thus, the installation of the sprinkler head is completed.

Next, the operation of the above-described sprinkler head will be described.

The sprinkler head main body 1 is connected to the water supply piping 5 filled with water in the ceiling, and is disposed so that only the cover plate 4 is visible from the ceiling surface as described above. If a fire occurs, the low melting alloy 16 connecting the cover plate 4 and the retainer 3 melts due to the heat from the fire.

The melting of the low melting alloy 16 decreases the bonding strength, causes the cover plate 4 to drop off, and exposes the sprinkler head main body 1 installed in the ceiling. Since the cover plate 4 is removed, the thermal air currents generated by the fire flow into the cylindrical member 2, and the cylinder 9 and the heat collector 10 are heated and promote the melting of the low melting alloy in the cylinder 9.

When the low melting alloy in the cylinder 9 melts, the heat sensitive operating portion supporting the valve closing the nozzle of the sprinkler head main body 1 breaks up, the valve moves away from the end of the nozzle, and the nozzle is opened.

The water filling the water supply piping 5 is discharged from the opened nozzle. The deflector 17 located on the extension of the nozzle and housed in the frame 8 is protruded from the frame 8. Water colliding with the deflector 17 scatters in all directions in the room and prevents spread of fire, and fire is extinguished (see FIG. 4).

REFERENCE NUMERALS

Figure 1:
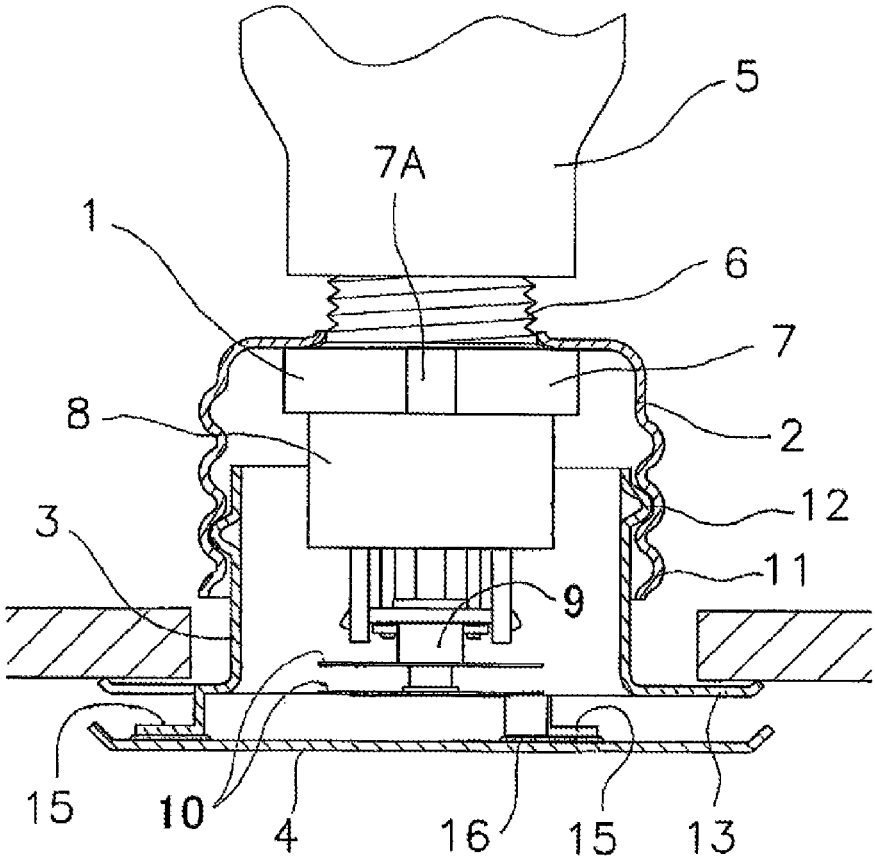
FIG. 1 is a sectional view of a sprinkler head of the present invention.
Figure 2:
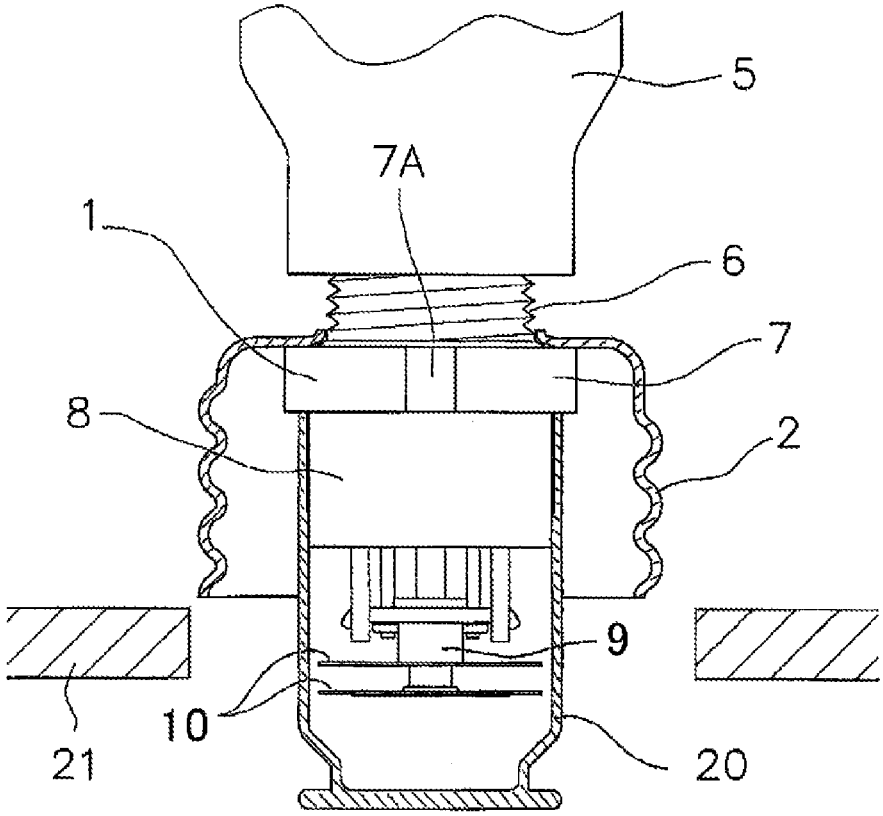
FIG. 2 is a sectional view of the sprinkler head attached to piping.
Figure 3:
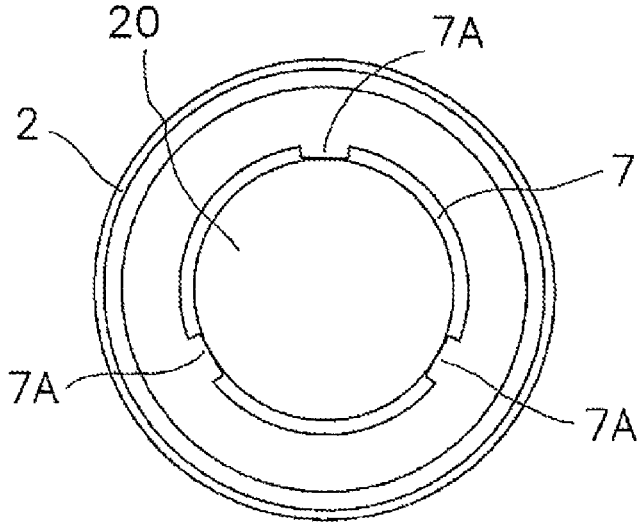
FIG. 3 is a bottom view of FIG. 2.
Figure 4:
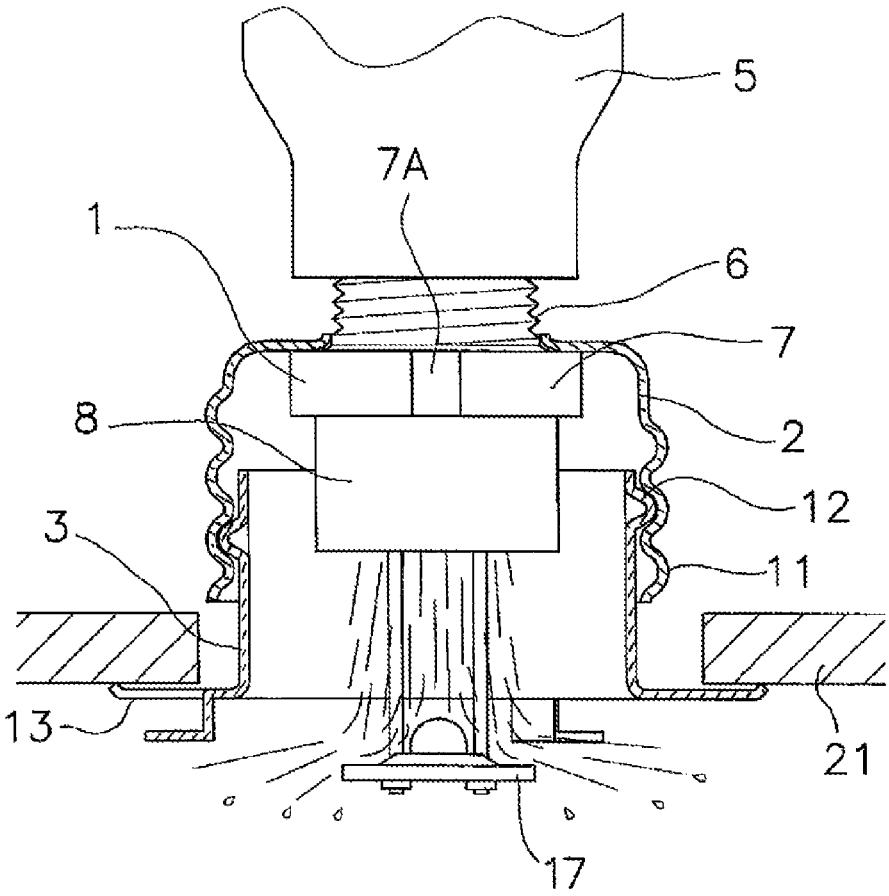
FIG. 4 shows the sprinkler head in operation.
Figure 5:
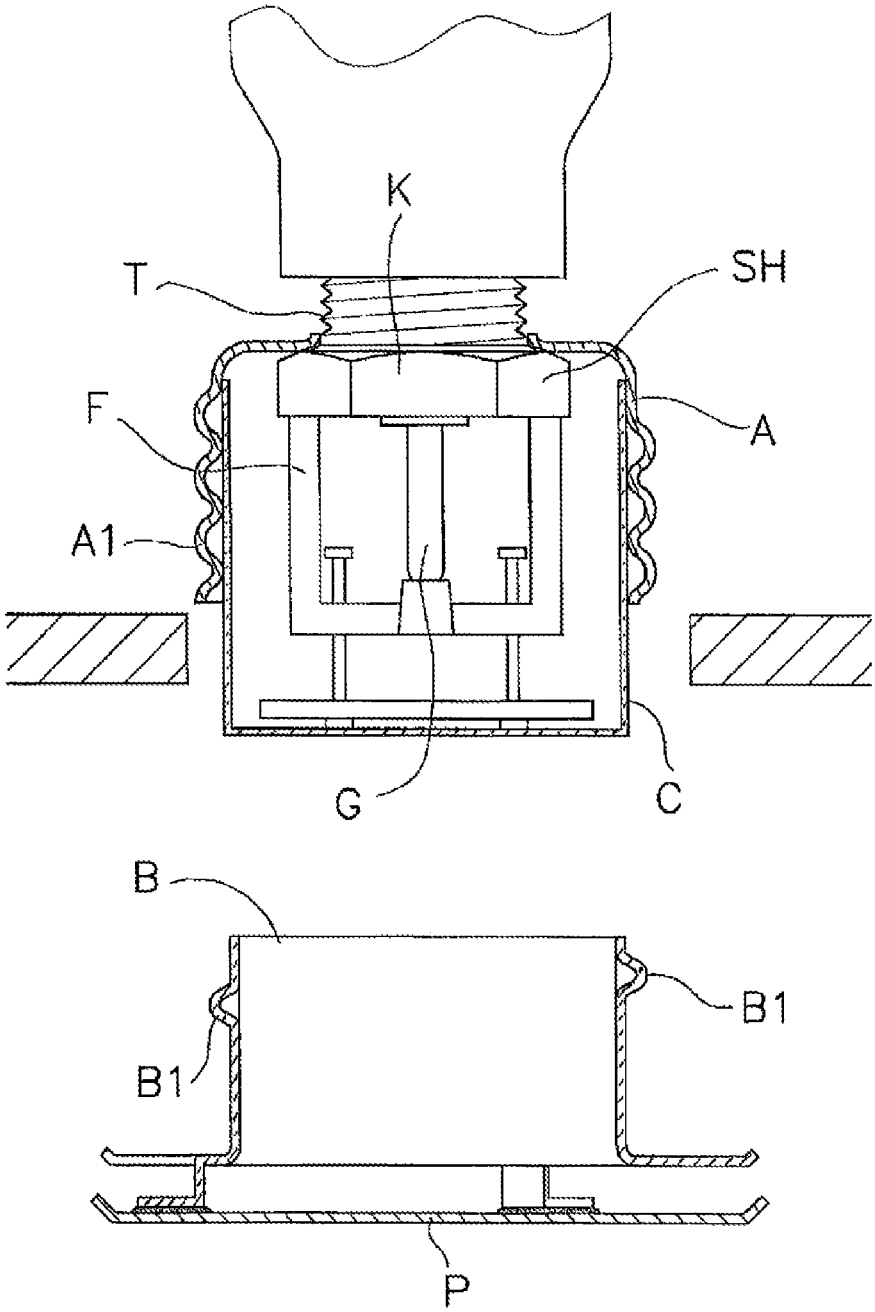
FIG. 5 shows a state where a protective cap is attached in FIG. 6.
Figure 6:
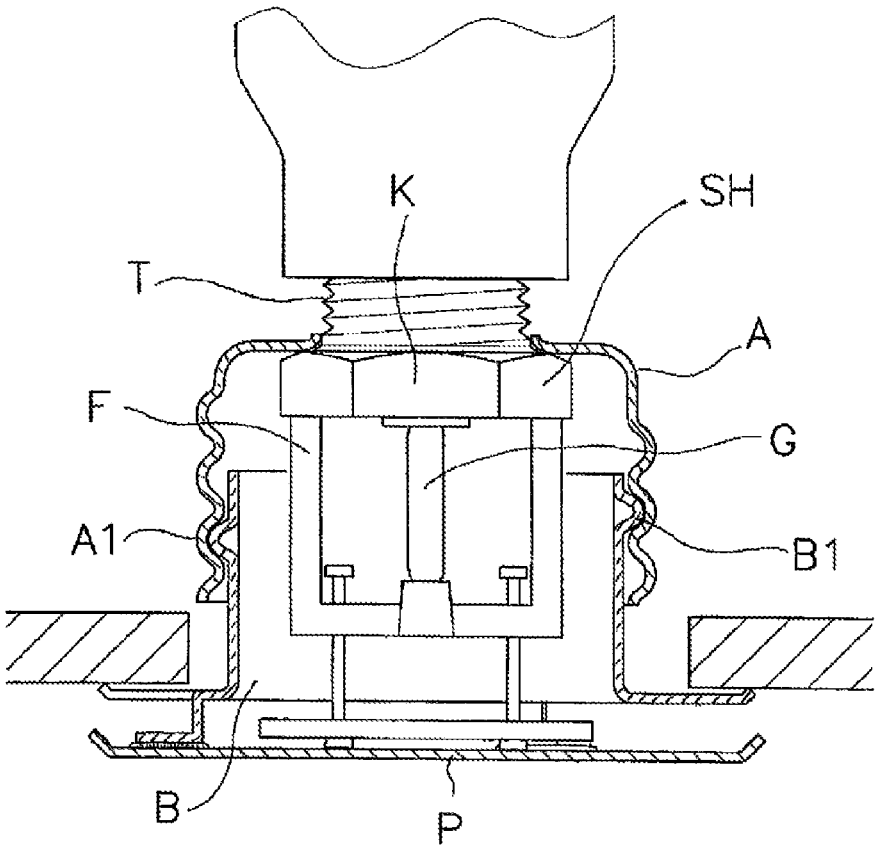
FIG. 6 is a sectional view of a conventional concealed type sprinkler head.

1 sprinkler head main body
2 cylindrical member
3 retainer
4 cover plate
5 water supply piping
7 flange portion
8 frame
20 protective cap

The invention claimed is:

1. A sprinkler head comprising:

a sprinkler head main body having a nozzle therein, connected to water supply piping, and installed in a ceiling;

a cover plate concealing the sprinkler head main body;

a retainer disposed so that the cover plate is located below the ceiling surface and capable of releasing the cover plate in the event of fire; and a cylindrical member that is attached to the sprinkler head main body and to which the retainer is detachably connected, wherein a protective cap attached to the sprinkler head is fitted to the outer periphery of the sprinkler head main body, wherein in the sprinkler head main body, the engaging portion to be engaged with the tightening tool has a diameter larger than the outside diameter of the protective cap and smaller than the inside diameter of the cylindrical member.

2. The sprinkler head according to claim 1, wherein an engaging portion to be engaged with a tightening tool for connecting the sprinkler head main body to the water supply piping is formed inside the cylindrical member.

3. The sprinkler head according to claim 1, wherein an engaging portion to be engaged with the tightening tool is formed between the protective cap attached to the sprinkler head main body and a connecting portion of the sprinkler head main body connected to the water supply piping.

4. The sprinkler head according to claim 1, wherein a deflector provided on the extension of the nozzle exit of the sprinkler head main body has such a structure that the deflector is normally housed in the sprinkler head main body and is protruded from the sprinkler head main body at the time of operation.

5. The sprinkler head according to claim 2, wherein an engaging portion to be engaged with the tightening tool is formed between the protective cap attached to the sprinkler head main body and a connecting portion of the sprinkler head main body connected to the water supply piping.

6. A sprinkler head comprising:

a sprinkler head main body having a nozzle therein, connected to water supply piping, and installed in a ceiling;

a cover plate concealing the sprinkler head main body;

a retainer disposed so that the cover plate is located below the ceiling surface and capable of releasing the cover plate in the event of fire;

a cylindrical member that is attached to the sprinkler head main body and to which the retainer is detachably connected, wherein a protective cap attached to the sprinkler head is fitted to the outer periphery of the sprinkler head main body, wherein an engaging portion to be engaged with a tightening tool for connecting the sprinkler head main body to the water supply piping is formed inside the cylindrical member, and wherein in the sprinkler head main body, the engaging portion to be engaged with the tightening tool has a diameter larger than the outside diameter of the protective cap and smaller than the inside diameter of the cylindrical member.

* * * * *